US008469227B2

(12) United States Patent
Tripsiznes

(10) Patent No.: US 8,469,227 B2
(45) Date of Patent: Jun. 25, 2013

(54) DEVICE TO ENHANCE AND PROLONG A HOT BEVERAGE DRINKING EXPERIENCE

(76) Inventor: Laxaros C. Tripsiznes, Hartsville, SC (US)

( * ) Notice: Subject to any disclaimer, the term of this patent is extended or adjusted under 35 U.S.C. 154(b) by 1058 days.

(21) Appl. No.: 11/980,186

(22) Filed: Oct. 30, 2007

(65) Prior Publication Data

US 2009/0108003 A1 Apr. 30, 2009

(51) Int. Cl.
*A47G 19/22* (2006.01)
*G01F 11/26* (2006.01)

(52) U.S. Cl.
USPC ..... 220/719; 220/714; 220/521; 222/454; 215/17; 215/21

(58) Field of Classification Search
USPC ..... 220/719, 521, 522, 713, 714; 215/17, 215/18, 21; 222/454
See application file for complete search history.

(56) References Cited

U.S. PATENT DOCUMENTS

| | | | | |
|---|---|---|---|---|
| 595,487 | A * | 12/1897 | Latham | 215/24 |
| 2,190,092 | A | 2/1940 | Bailey | |
| 2,204,104 | A | 6/1940 | Masters | |
| 3,152,735 | A | 10/1964 | Caldwell | |
| 4,116,371 | A | 9/1978 | Towns et al. | |
| 4,613,064 | A | 9/1986 | Meyer et al. | |
| 5,054,660 | A | 10/1991 | Sherman et al. | |
| 5,261,575 | A | 11/1993 | Keller | |
| 6,176,390 | B1 | 1/2001 | Kemp | |
| 6,305,571 | B1 * | 10/2001 | Chu | 220/719 |
| 6,318,584 | B1 * | 11/2001 | Milan | 220/713 |
| 6,488,173 | B2 * | 12/2002 | Milan | 220/713 |
| 6,571,973 | B1 | 6/2003 | Tripsianes | |
| 6,702,145 | B2 * | 3/2004 | Malcolm | 220/713 |
| 6,811,049 | B2 * | 11/2004 | Lukacevic | 220/254.3 |
| 2002/0003145 | A1 * | 1/2002 | Milan | 220/713 |
| 2004/0232154 | A1 * | 11/2004 | Smith et al. | 220/713 |
| 2005/0087539 | A1 * | 4/2005 | Waller | 220/713 |
| 2006/0124645 | A1 * | 6/2006 | Peitersen | 220/374 |

* cited by examiner

*Primary Examiner* — Anthony Stashick
*Assistant Examiner* — James N Smalley
(74) *Attorney, Agent, or Firm* — Clifford Kraft

(57) ABSTRACT

A device for a cup and lid providing a thermal shield to keep the cup's liquid contents hot and facilitating the interval transfer, temporary storage, and cooling of a small amount of liquid prior to drinking. The conservation of heat energy within the cup allows the preservation of aroma and taste, a definite must for a prolonged and enjoyable drinking experience, while a controlled volume of the beverage cools down to a palatable temperature. Also, when the device is used in conjunction with a disposable cup and lid assembly, it improves the stiffness characteristics of the containment assembly, thereby preventing potential spillage or discharge of the hot contents due to accidental or improper handling.

13 Claims, 14 Drawing Sheets

FIG. 2
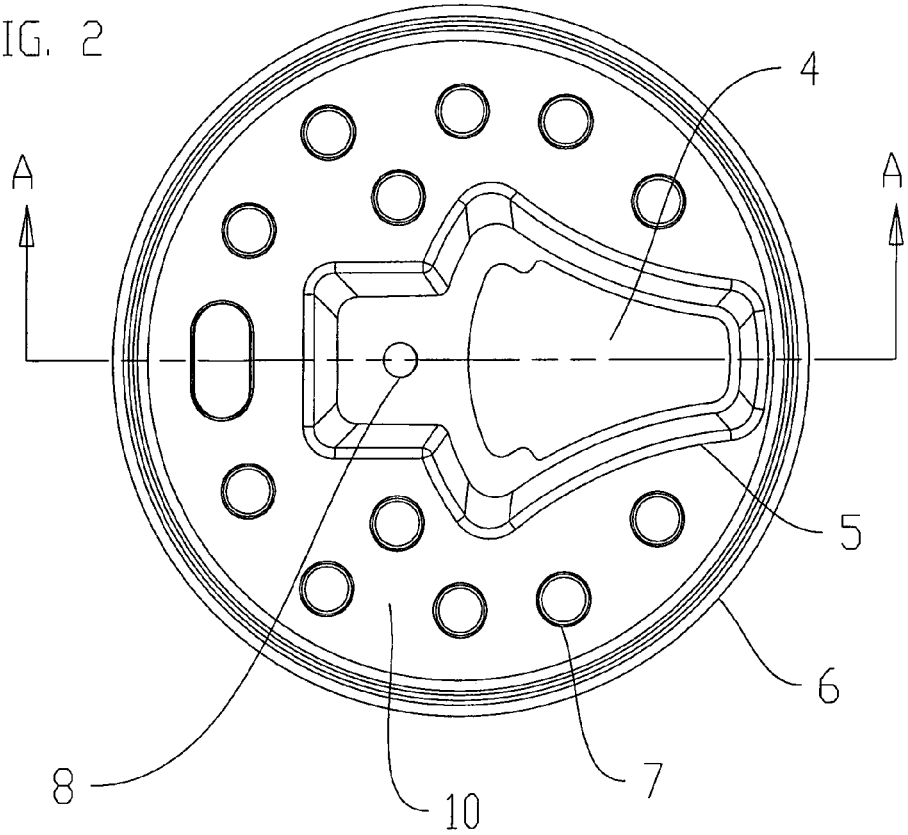
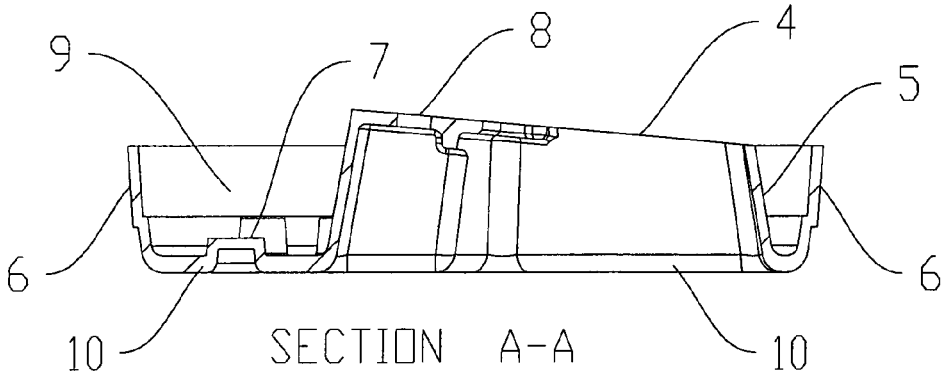
FIG. 3

SECTION A-A

SECTION A-A

SECTION A-A

SECTION A-A

SECTION A-A

SECTION A-A

SECTION A-A

SECTION A-A

SECTION A-A

DEVICE TO ENHANCE AND PROLONG A HOT BEVERAGE DRINKING EXPERIENCE

BACKGROUND OF THE INVENTION

This invention solves a common coffee drinker's dilemma: drinking coffee at an ideal drinking temperature. The difficulty in deriving the most pleasure from coffee is that it is ideally brewed at 190 to 200 degrees Fahrenheit, while ideal drinking temperature is from 150 to 160 degrees Fahrenheit, hot enough for full flavor, but not hot enough to burn the drinker. Thus, once brewed and served, the drinker must wait patiently for the drink to cool to his or her preferred temperature before drinking, or undertake a serious risk of burning the mouth. Once the coffee reaches the preferred temperature, the drinker has only minutes to consume the contents of the cup, as the drink will quickly cool and become unpleasant.

The industry, through the introduction of "Cooling Dome" lid designs, tried to make the drinking of coffee as pleasant as possible by increasing the rate at which it cools. Besides the aesthetic and safety related qualities, the primary goal (by increasing the surface area of the lid) is to expedite the cooling rate of the cup's liquid contents. While this may present advantages for many users the design lacks flexibility and for slow drinkers it even presents disadvantages, because the contents of the cup will cool down too quickly and soon after will lose flavor and aroma resulting in an unpleasant drinking experience.

The alternative is to keep the coffee hot as long as possible. However, this dramatically increases the amount of time that the consumer has to wait to enjoy the coffee at its ideal drinking temperature. It is often frustrating to consumers who may want to start drinking right away.

Ideally, the coffee drinker would want not only to quickly enjoy coffee at an ideal drinking temperature, but also to keep the coffee from getting cold for the entire duration of the drinking experience. This invention allows the drinker to meet these requirements.

SUMMARY OF THE INVENTION

The primary objective of the present invention is to allow the drinker quick access to a hot beverage at his or her preferred drinking temperature. Another object of the present invention is to keep the beverage from getting cold for as long as possible. Another object of the present invention is to limit spillage of the contents of the cup. For disposable applications, another object of the present invention is that the cup's structural rigidity is improved such that it is less prone to buckling during handling, when the cup contains a hot beverage.

The above objectives, as well as additional advantages, will be realized in the practice of the invention as herein described. In its broadest embodiment, the invention is a device that comprises a first component creating a physical barrier that separates the interior of a cup and lid into an upper compartment designed for cooling and a lower compartment designed to keep the liquid contents hot. The device also comprises an opening in the physical barrier designed to allow the transfer of a small amount of liquid from the lower compartment through the physical barrier to the upper compartment when the cup is tipped, but also to retain a controlled volume of liquid in the upper compartment when the cup is returned to its upright orientation.

The method of drinking from a cup with the above-described device installed comprises the following steps: 1) first tipping the cup toward the opening in the physical barrier so that liquid in the lower compartment of the cup flows through the opening in the physical barrier to the upper compartment; 2) returning the cup to its upright orientation, having trapped a portion of liquid in the upper compartment and allowing to cool to the ideal drinking temperature, and 3) tipping the cup toward the sip opening so that liquid in the upper compartment flows to the sip opening for consumption.

These and other objects, features, and aspects of the present invention will be apparent from the following description of the preferred embodiments taken in conjunction with the attached drawings.

BRIEF DESCRIPTION OF THE FIGURES

FIG. 2 is a top view of the preferred embodiment of the invention for disposable cups.

FIG. 3 is a cross section of the device of FIG. 2 taken along line "A-A" in FIG. 2.

DETAILED DESCRIPTION OF THE INVENTION

Figure 1:
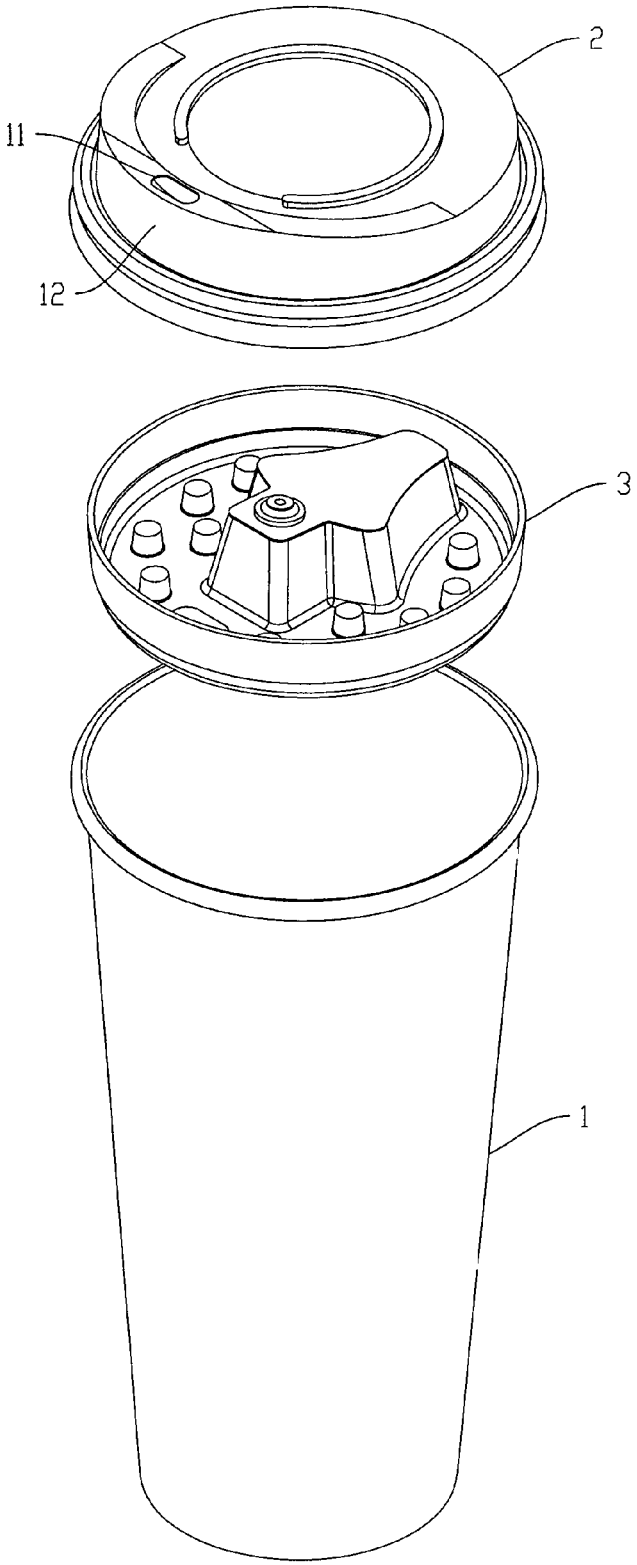
FIG. 1 is an exploded perspective drawing showing a disposable cup, a "cooling dome" lid for said cup, and the preferred embodiment of the invention for disposable cups.

FIG. 1 illustrates an embodiment of the invention for a disposable cup (1) and "cooling dome" lid (2), in exploded form, showing the present invention embodied in a device (3) to be used in conjunction with a cup (1) and a lid (2). The device (3) can be adapted to fit into any paper, plastic, or polystyrene disposable coffee cups, such as are generally available from restaurants and coffeehouses, but any device in accordance with the present invention may be used with any cup or bowl, disposable or non-disposable. Moreover, while the following description uses coffee as an example of the liquid held within the cup (1) and lid (2), it will be understood that the lid in accordance with the present invention may be used with a cup or bowl containing any hot liquid.

As shown in FIG. 2, the device (3) has two primary elements: a physical barrier (10) designed to divide the interior of the cup (1) and lid (2) into an upper compartment (16) and a lower compartment (17); and an opening (4) in the physical barrier (10) to allow for the transfer of contents from the lower compartment (17) to the upper compartment (16). The device (3), in this embodiment, is generally in the form of a horizontal dish, with a primarily horizontal physical barrier (10), a perimeter wall (6) designed to fit the inner wall (18) of a cup (1), and a raised wall (5) structure housing an opening (4) in the physical barrier (10). The physical barrier (10) in this embodiment is horizontal, but in other embodiments may be sloped, curved, or even partially vertical. The opening (4) in this embodiment is raised with respect to the physical barrier (10) to retain liquid, although other possible embodiments exist.

FIG. 3 shows a cross-section of the device (3) taken longitudinally along the long axis of the opening (4). Illustrated here is that the opening (4) is raised with respect to the level of the physical barrier (10). This is accomplished in this embodiment by means of a raised wall (5) surrounding the opening (4) in the physical barrier (10). The raising of the opening (4) provides for a basin (9) in which liquid can be retained when the cup (1) is returned from its tipped orientation to its upright orientation. A small hole (8) in the top of the raised wall (5) is provided for venting to enhance the liquid transfer process when the cup (1) is tilted.

Figure 4:
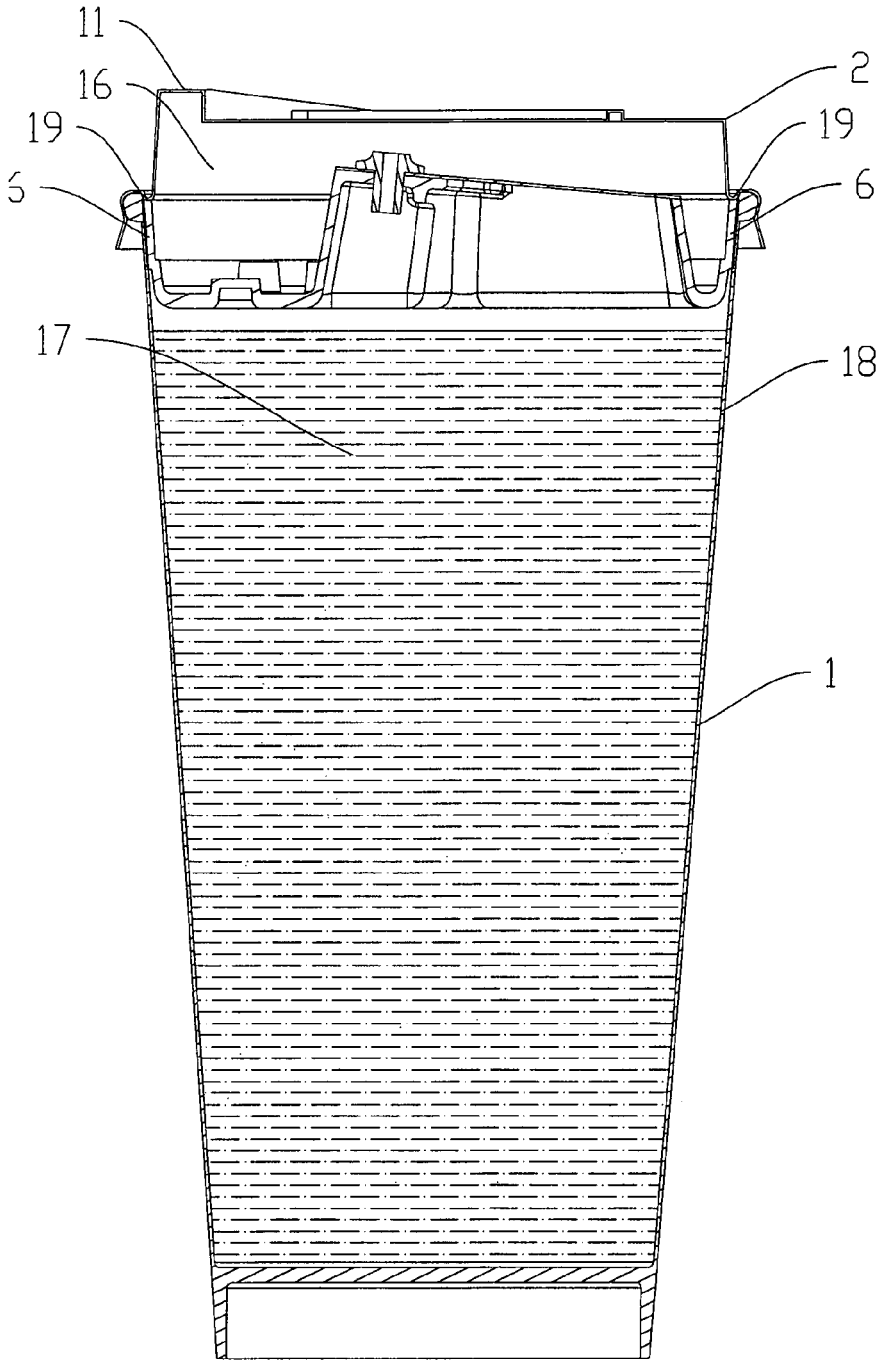
FIG. 4 is a cross-section of the device of FIG. 2 taken along line "A-A" in FIG. 2 in conjunction with a cup having an attached "cooling dome" lid in accordance with the preferred disposable embodiment of the present invention.

FIG. 4 shows the cup (1), "cooling dome" lid (2), and device (3) assembled in cross section. Here the function of the physical barrier (10) can be seen dividing the interior of the cup (1) into two compartments, an upper compartment (16) and a lower compartment (17). The upper compartment (16) is bounded by the lid (2), the perimeter wall (6) of the device (3), and the physical barrier (10), and in some instances the inner wall (18) of the cup (1), while the lower compartment (17) is formed by the cup (1) and the physical barrier (10) of the device (3). The perimeter wall (6) of the device (3) secures the device (3) in place within the cup (1). The perimeter wall (6) of the device (3) is designed to maintain full contact with the perimeter (19) of the lid (2) in the vicinity of the rim of the cup (1), which secures further its positioning within the cup (1) and lid (2) assembly.

Figure 5:
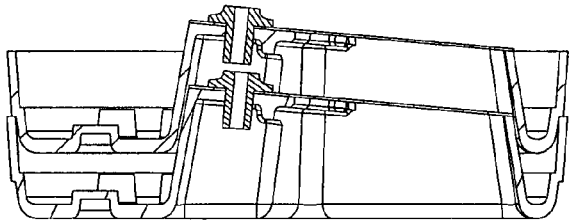
FIG. 5 is a cross-section of the device of FIG. 2 taken along line "A-A" in FIG. 2 in conjunction with a second identical device shown stacked with one another.

FIG. 5 is a cross-sectional view of two of the devices (3) shown stacked together.

Figure 6:
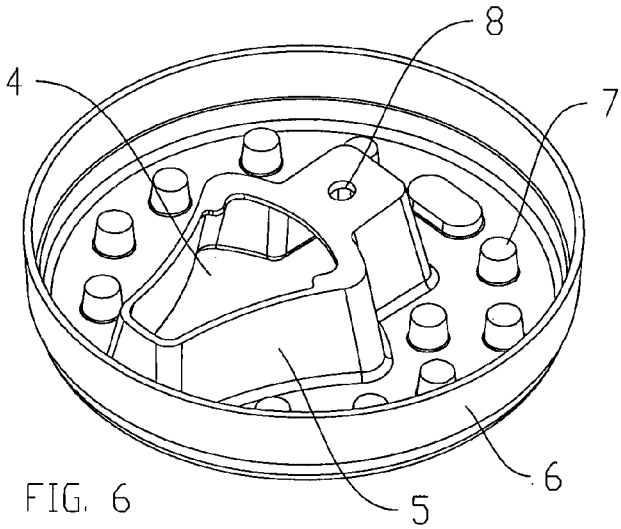
FIG. 6 is a perspective view of the device of FIG. 2 showing the top of the device.
Figure 7:
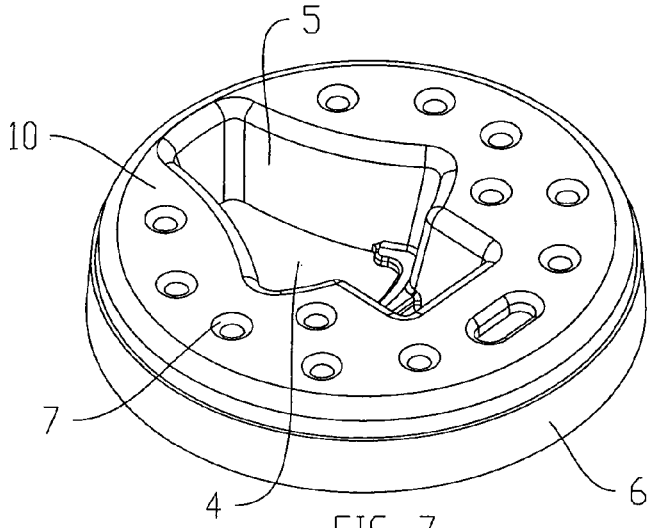
FIG. 7 is a perspective view of the device of FIG. 2 showing the bottom of the device.

FIGS. 6 and 7 show the device (3) in perspective to demonstrate some of the three-dimensional features of the invention. The raised wall (5) that houses the opening (4) can clearly be seen here. Also of note are the various geometric extensions (7) in a transverse direction from the physical barrier (10). These geometric extensions (7) serve a dual purpose: on the one hand, they serve to agitate the mass of the liquid contents in the upper compartment (16) and therefore expedite cooling; on the other hand, they serve as physical flow restrictors to control splashing and minimize spilling of the liquid in the upper compartment (16) through the sip opening (11). Also visible is the vent hole (8) which allows air to pass into the lower compartment (17) to aid in the transfer of contents from the lower compartment (17) to the upper compartment (16).

Figure 8:
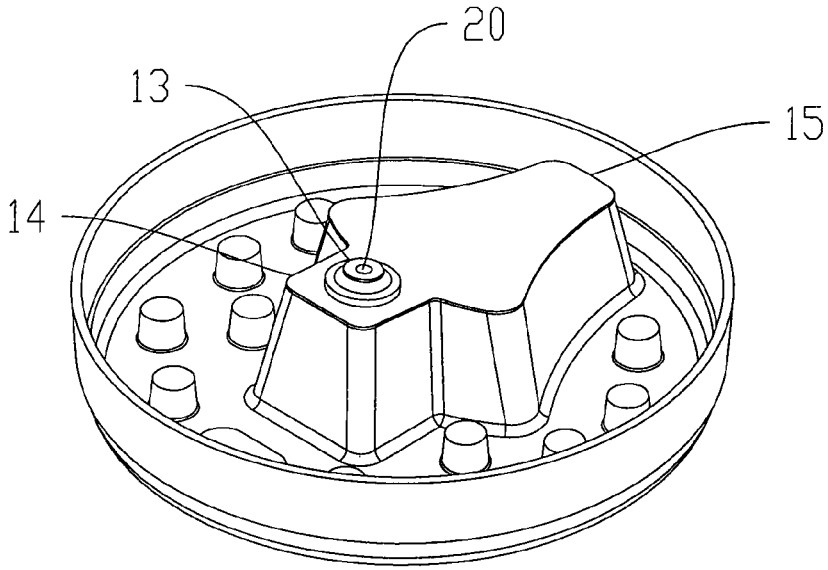
FIG. 8 is a perspective view of the device of FIG. 2, shown with the addition of a pin, vent-hole, and flap gate.
Figure 9:
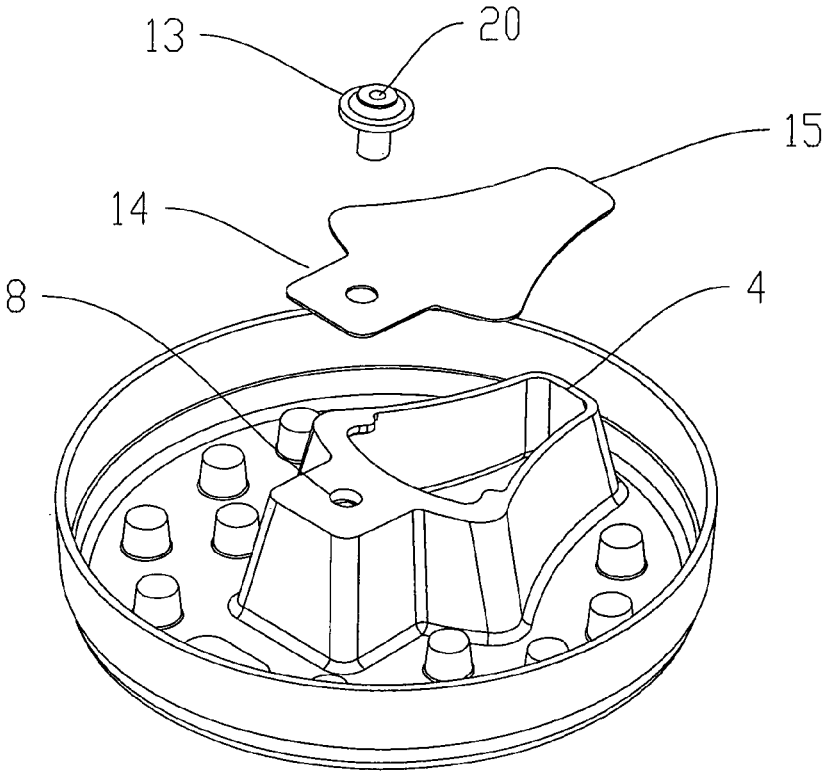
FIG. 9 is an exploded perspective drawing of the device in FIG. 8.

FIGS. 8 and 9 show the device (3) with the addition of an optional feature comprising a flap gate (15) over the opening (4). The flap gate (15) is designed to cover the opening (4) in the physical barrier (10) when the cup (1) is in its upright orientation, in order to confine vapors to the lower compartment (17). The flap gate (15) in this embodiment is constructed of a semi-rigid material to cover the opening (4), but is flexible enough to be forced open by the liquid contents of the cup (1) when it is its tipped orientation. The flap gate (15) in this embodiment is affixed to the device (3) by means of a pin (13) which is pierced through the physical barrier (10) at the designated location and is held in place through friction. The pin (13) itself has a hole (20) along its main axis to provide venting for the lower compartment (17) when the cup is tipped.

Figure 10:
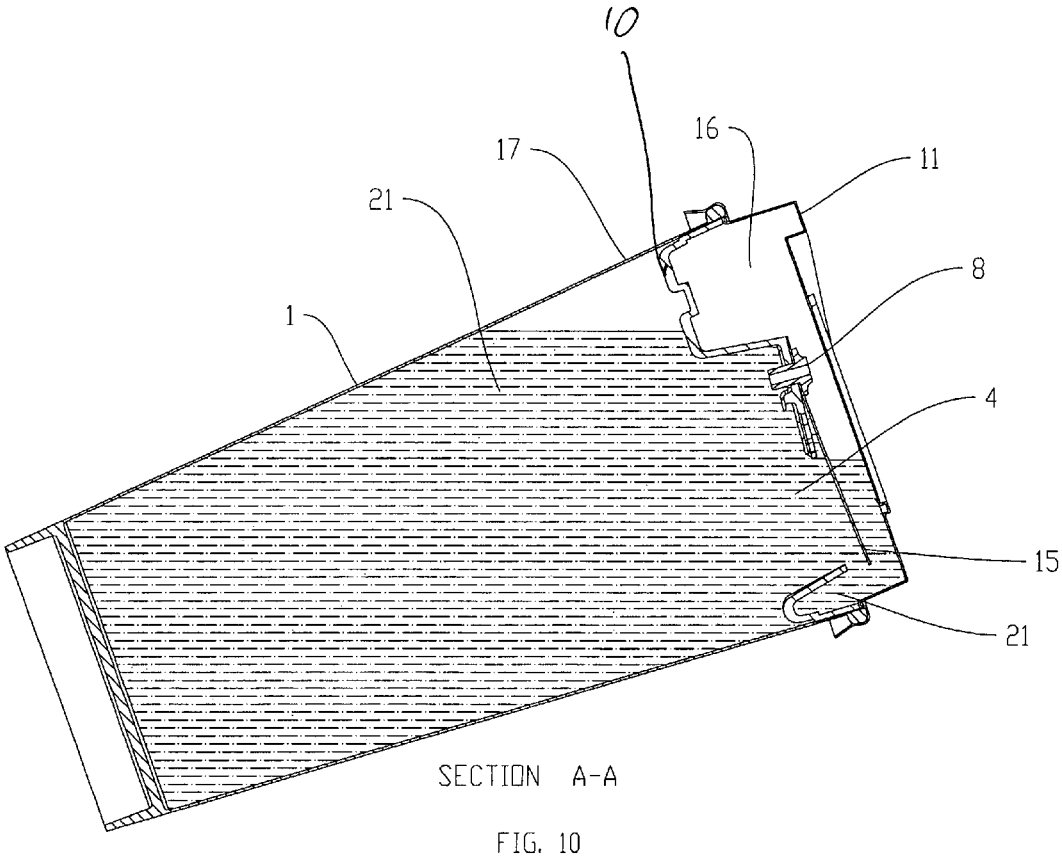
FIG. 10 is a cross-section of the device of FIG. 2 taken along line "A-A" in FIG. 2 in conjunction with a cup having an attached "cooling dome" lid and filled with liquid, shown in its tipped orientation.
Figure 11:
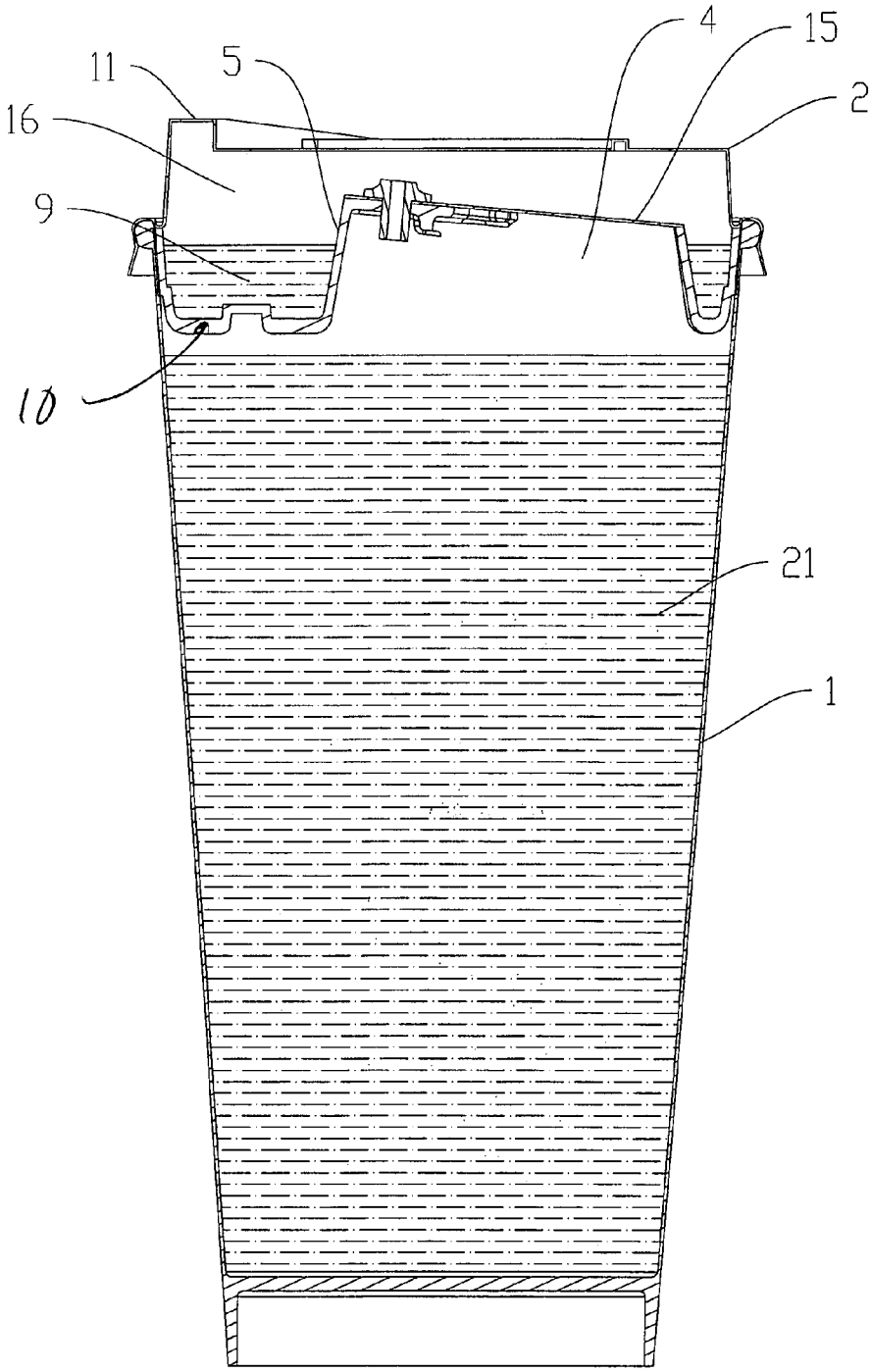
FIG. 11 is a cross-section of the device of FIG. 2 taken along line "A-A" in FIG. 2 in conjunction with a cup having an attached "cooling dome" lid and filled with liquid, shown after being returned to its upright orientation from its tipped orientation.
Figure 12:
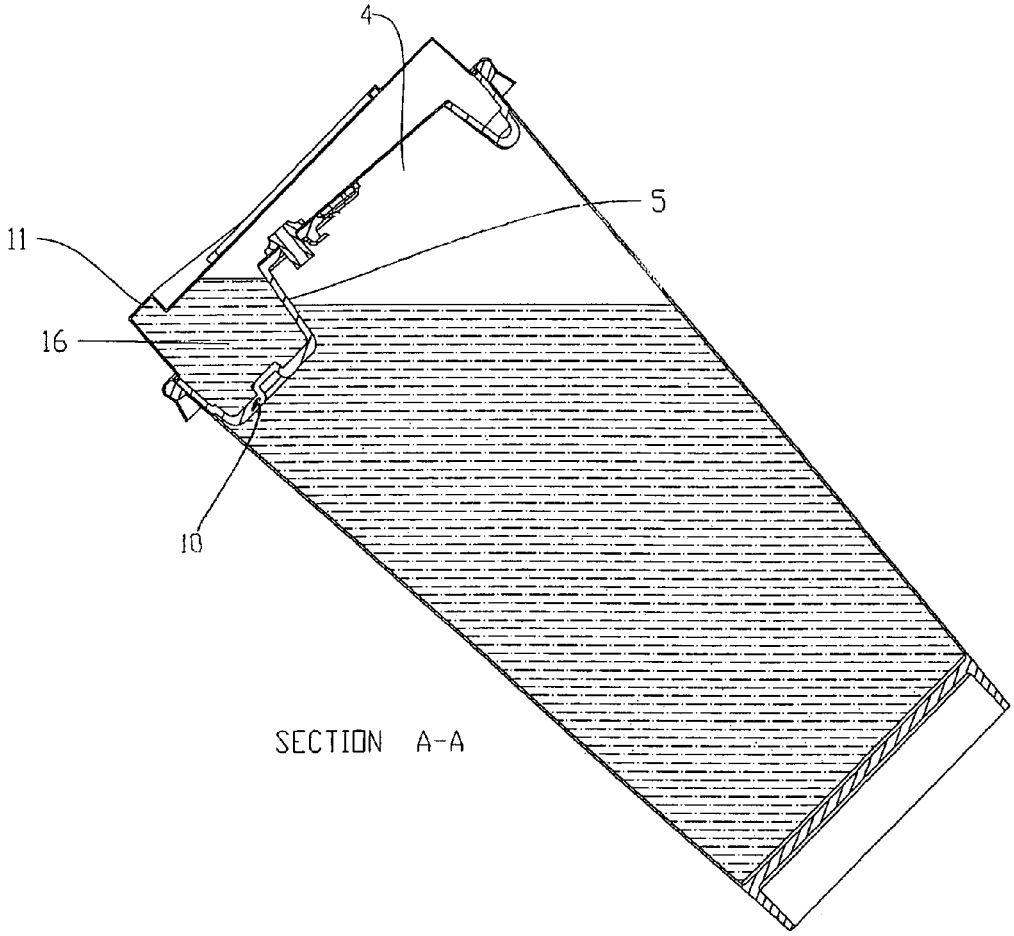
FIG. 12 is a cross-section of the device of FIG. 2 taken along line "A-A" in FIG. 2 in conjunction with a cup having an attached "cooling dome" lid and filled with liquid, shown in the sipping orientation after the upper compartment has been filled.

FIGS. 10 thru 12 illustrate the three positions of the cup (1) when the invention is used. FIG. 10 illustrates the cup (1) in its tipped orientation; FIG. 11 illustrates the cup (1) in its upright orientation after the upper compartment (16) has been filled; and FIG. 12 illustrates the cup (1) in its sipping orientation. These Figures are conceptual, and they do not correspond exactly to but rather illustrate various levels of the liquid contents within the cup (1). As a result, these Figures provide an approximate view of the relationships between the elements of the invention and the liquid contents of the cup (1). In particular, these Figures demonstrate the relationships between the upper compartment (16), the physical barrier (10), the opening, (4), and the lower compartment (17) of the cup (1) and lid (2) assembly.

FIG. 10 demonstrates the tipped orientation of the cup (1), lid (2), and device (3). When the cup (1) is tipped toward the opening (4), liquid contents will flow from within the lower compartment (17) through the opening (4) and into the upper compartment (16). The hot liquid contents transferred to the upper compartment (16) are confined between the physical barrier (10) and the lid (2). This process requires that the sip opening (11) be located substantially diametrically opposite the opening (4), otherwise the hot liquid contents will spill through the sip opening (11) when the cup (1) is in its tipped orientation.

The "cooling cycle" use of the device (3) to provide quick sips of cooled liquid contents is as follows: FIG. 4 illustrates the cup (1) in its initial upright orientation. Initially, there are hot liquid contents only in the lower compartment (17) of the cup (1). The user will usually be holding the cup (1) so that the sip opening (11) is facing towards him, with the opening (4) facing opposite him.

As shown in FIG. 10, the cup (1) is then tipped to its tipped orientation, away from the drinker and towards the opening (4). As a result, the hot liquid contents in the cup (1) flow out through the opening (4) and into the upper compartment (16). The opening (4) is located away from the center of the physical barrier (10) in the direction of tipping to facilitate the transfer of liquid contents from the lower compartment (17) to the upper compartment (16). Because of the positioning of the opening (4) relative to the sip opening (11), at the tipped orientation the hot liquid coffee will flow only from the lower compartment (17) of the cup (1) to the upper compartment (16), safely away from sip opening (11).

The amount of liquid transferred to the upper compartment (16) is controlled by various geometric features defining the upper compartment (16), such as: the size location, and height of the opening (4), the geometric configuration of the lid (2), the tip angle of the assembly, and the stiffness of the flap gate (15), if present. Through testing and experimentation, the above design elements can be modified in relation to each other to control the volume of liquid transferred to 1 oz. to 1.5 oz.

The optional flap gate (15), when installed, will flex open by the flow of the liquid contents when the liquid contents to pass into the upper compartment (16), and will flex back to its normal (closed) position when the liquid transfer reaches a stable equilibrium. When the cup (1) is returned to its upright orientation, the relatively small amount of hot liquid contents in the upper compartment (16), ideally about 1 oz. to 1.5 oz., will be retained in the basin (9) formed by the raised wall (5) of the opening (4), the perimeter wall (6), and the physical barrier (10). The contents of the upper compartment (16) now cool to an ideal drinking temperature, while the contents of the lower compartment (17) are substantially maintained at their original temperature. The optional flap gate (15), if used, covers the opening (4), trapping vapors in the lower compartment (17) to keep heat from escaping into the upper compartment (16).

As shown in FIG. 11, the upper compartment (16) is bounded on one side by a "Cooling Dome" lid (2), which by nature of its design, is intentionally vaulted to increase the surface area of the lid and is generally thin to facilitate and accelerate the heat exchange rate and speed cooling. As part of the process, hot vapors condense on the "Cooling Dome" lid's inner surface and drip back into the cup, cooling the liquid contents. Thus, with this invention, the small volume of liquid contents contained in the upper compartment (16) will have full access to the full cooling capacity of the "Cooling Dome" lid (2), which prior to this invention was afforded undesirably to the entire contents of the cup (1). In addition, the lower compartment (17), through the presence of the physical barrier, now has added thermal insulating capacity, allowing it to be kept hot for extended periods of time.

When the drinker wishes to take a sip, he performs the natural act of tipping the cup (1) towards him to its sipping orientation, as illustrated in FIG. 12. This causes the cooled liquid contents in the upper compartment (16) to flow to the sip opening (11) for consumption. During this process, the physical barrier (10) having an opening substantially away from the center and diametrically opposite the sip opening (11), prevents any of the hot liquid contents in the lower compartment (17) from flowing into the upper compartment (16) or to the sip opening (11). Thus, the sip opening (11) is not directly accessible from the lower compartment (17) when the cup (1) is in its sipping orientation.

When the cup (1) is returned to its upright orientation, some amount of cooled liquid will remain in the upper compartment (16), and will aid in cooling down of any hot liquid transferred to the upper compartment (16) when the cooling cycle is repeated. The cooling process could be further expedited if the user deliberately allows an additional amount of liquid to remain in the upper compartment (16) after sipping so that newly transferred hot liquid will mix with this leftover cooled liquid. Also, when the temperature of the lower compartment (17) reaches a safe and palatable temperature, the user may bypass the cooling cycle by rotating the lid (2) of the cup (1) 180% so that it is aligned with the opening (4), which will allow direct access to the liquid contents of the cup (1).

Figure 13:
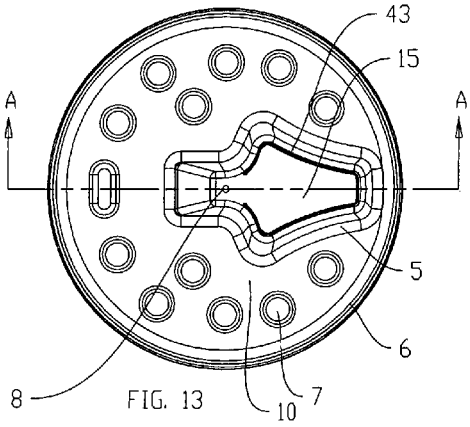
FIG. 13 is a top view of a thermoformed or vacuum formed embodiment of the invention.
Figure 14:
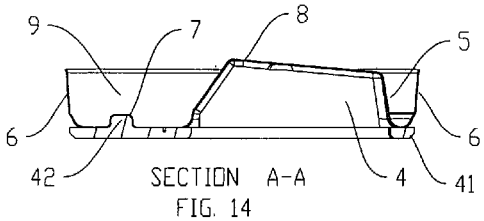
FIG. 14 is a cross section of the device of FIG. 13 taken along line "A-A" in FIG. 13.
Figure 15:
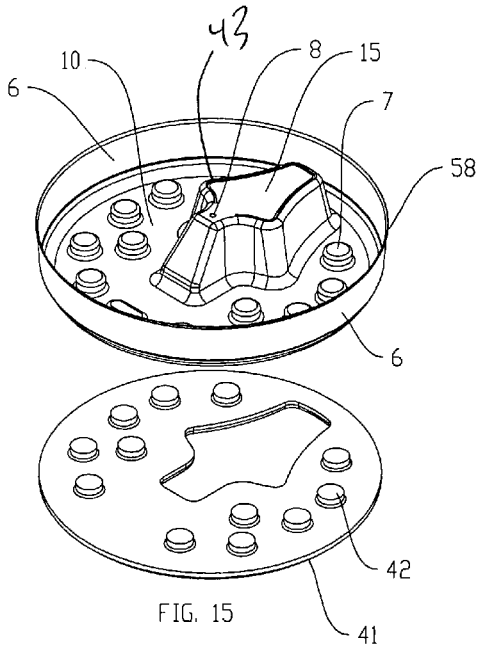
FIG. 15 is a perspective exploded view of the device of FIG. 13 showing the top of the device and thermal shield.

FIGS. 13, 14, and 15 depict an alternative embodiment for the disposable market. This embodiment includes many of the basic features of the preferred embodiment detailed above, including the physical barrier (10), the opening (4), the raised wall (5) of the opening (4), and the perimeter wall (6) of the device (3). Unlike the embodiment of FIG. 2, which is formed of expanded polystyrene, this design uses the same vacuum-formed or thermoformed polystyrene used by the industry in the manufacture of disposable lids. Alternately, this design can be constructed of flexible foam using a stamping process. The primary advantage of this design is that it does not require the separate manufacture and attachment of a flap gate (15), since it created as a part of the original forming or stamping process, requiring only a press cut process to define its geometric pattern (43).

This embodiment is cheaper and thus advantageous, but because the materials used have relatively low thermal insulating capacity, the addition of "thermal shield" (41) (see FIG. 15) constructed of a thermal insulating material, such as expanded polystyrene, may be adapted to compensate for potential heat losses, and can be assembled by pressing the pieces together while aligned in their proper orientation. The geometric extensions (42) present on the surface of the "thermal shield" (41) will engage with the corresponding geometric extensions (7) and held in place through friction. Other methods, such as adhesives, can also be used in the process.

Figure 16:
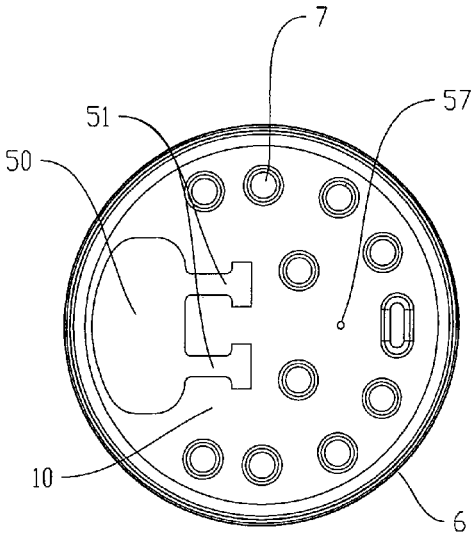
FIG. 16 is a top view of an embodiment of the invention that uses a check valve on the surface of the physical barrier.
Figure 17:
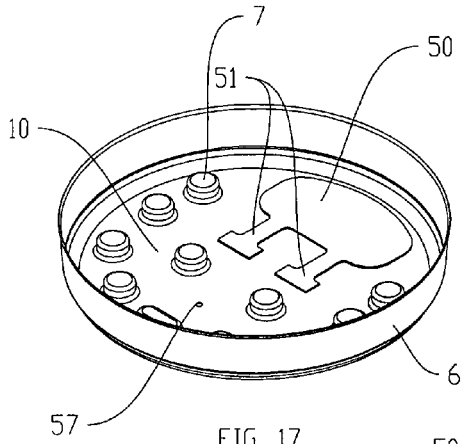
FIG. 17 is a perspective view of the device of FIG. 16.
Figure 18:
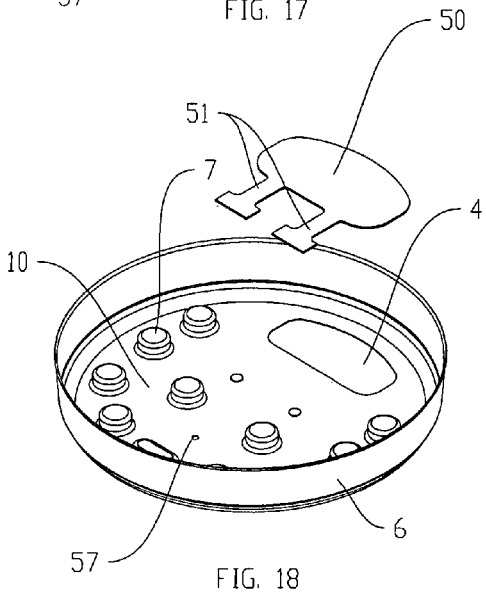
FIG. 18 is an exploded perspective view of the device of FIG. 16.
Figure 19:
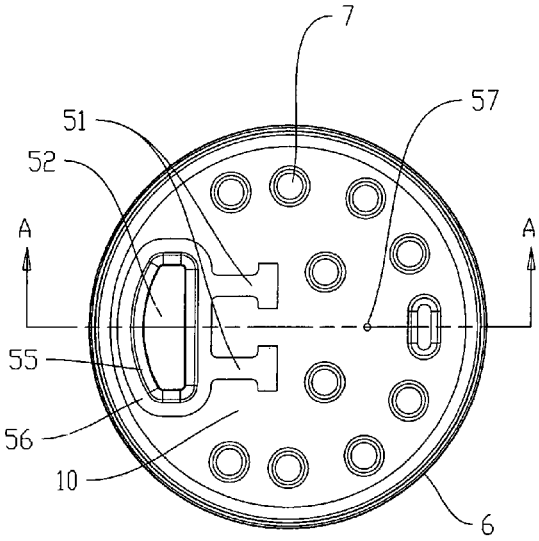
FIG. 19 is a top view of an embodiment of the invention that uses a recessed check valve on the surface of the physical barrier.
Figure 20:
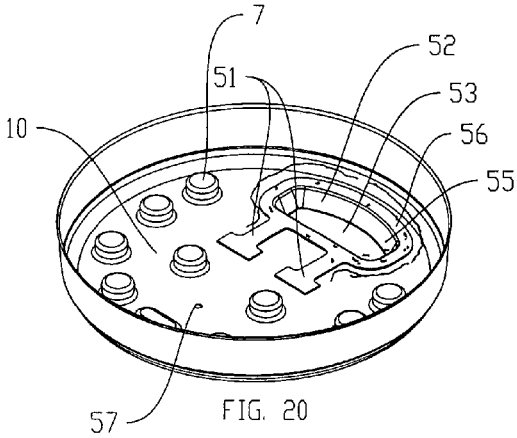
FIG. 20 is a perspective view of the device of FIG. 19.
Figure 21:
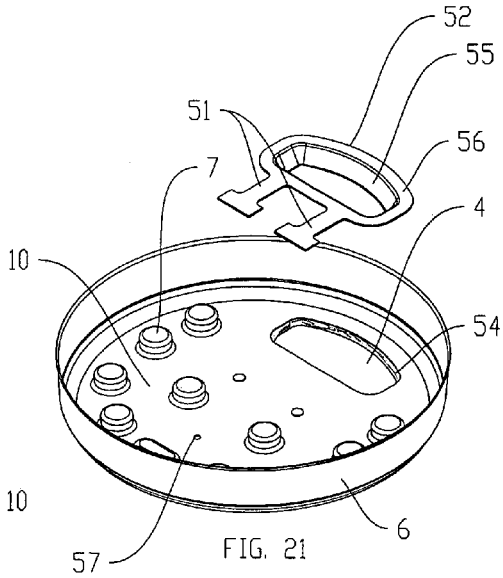
FIG. 21 is an exploded perspective view of the device of FIG. 19.
Figure 22:
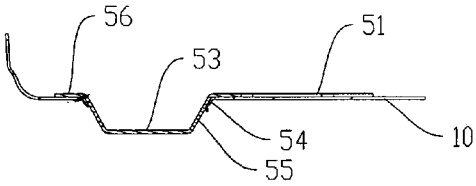
FIG. 22 is a cross section enlargement of the recessed check valve of the device of FIG. 19 taken along line "A-A" in FIG. 19.
Figure 24:
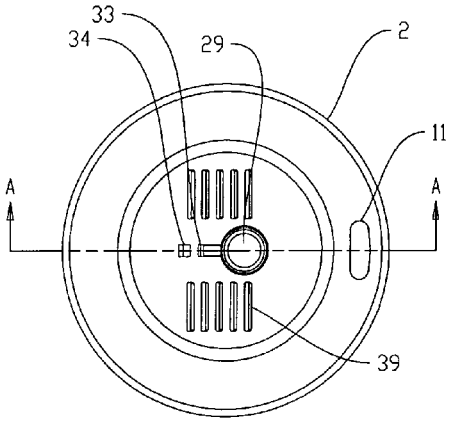
FIG. 24 is a top view of the preferred coffee mug assembly.

FIGS. 16, 17, and 18 depict another embodiment of the disposable device. This embodiment includes many of the basic features of the preferred embodiment detailed above, including the physical barrier (10), the opening (4), and the perimeter wall (6) of the device (3). In this embodiment, however, the hot liquids contents are not retained in the upper compartment (16) by raising the opening (4) with respect to the physical barrier (10), but rather by a check valve (50) located on the surface of the physical barrier (10). The check valve (50) is made of thin plastic (polystyrene) or other compatible materials and is designed proportionally larger so as to overlap and extend beyond the perimeter of the opening (4), and has integral extensions (51) fixed to the surface of the physical barrier (16), allowing the check valve (50) to flex and provide a pathway for the transfer of liquid contents from the lower compartment (17) to the upper compartment (16), while the cup is in its tipped orientation. Leakage is prevented or limited because hydrostatic pressure is exerted upon the check valve (50) by the weight of the liquid contents above it, which presses the check valve (50) to the surface of the physical barrier (10), and also because the adhesive intermolecular forces of liquid molecules trapped between the smooth overlapping surfaces of the check valve (50) and the physical barrier (10), forces similar to capillary action, are greater than the cohesive intermolecular forces within the liquid itself. A small vent hole (57), allows for the transfer of air from the upper compartment (16) to the lower compartment (17) to aid in the transfer of liquid contents when the cup (1) is in its tipped orientation.

FIGS. 19, 20, 21 and 22 depict a further development of the device of FIGS. 16, 17, and 18 in which a recessed check valve (52) is used. The recessed check valve (52) design increases the pressure between the overlapping surfaces of the physical barrier (10) and the recessed check valve (52) and improve conditions for a leak-tight seal. The transverse geometric features (55) increase the overall stiffness of the recessed check valve (52), and prevent local deformation so that the overlapping portion (56) of the recessed check valve (52) maintain full contact with the physical barrier (10). The added depth of the liquid in the recessed cavity (53) of the recessed check valve (52) increases the differential pressure between the two surfaces.

Figures 29, 30:
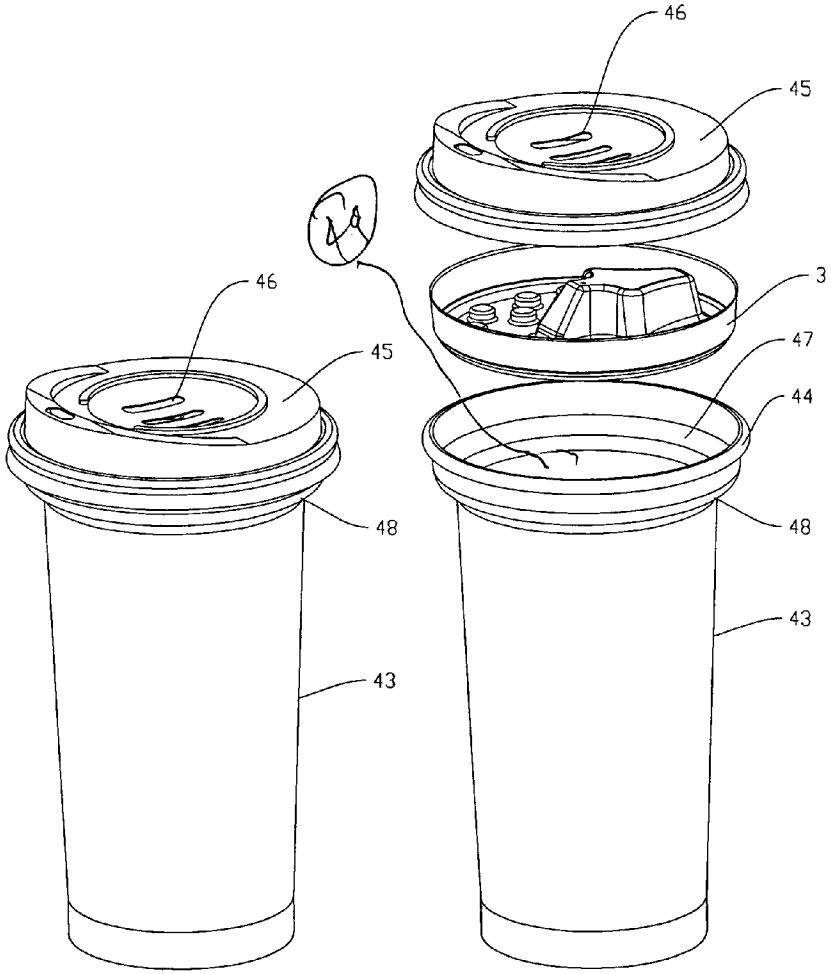
FIG. 29 is a perspective view of an alternative cup and lid that are designed to maximize the performance of the invention.
FIG. 30 is a perspective exploded view of the device of FIG. 29.

The cup (1) and the lid (2) may themselves be modified as shown in FIGS. 29 and 30 to optimize the function of the invention. The modified cup (43) has a flared transition (48) near the rim (44), which enlarges the diameter of the rim (44) and results in a support base (47) that accommodates and secures the device (3). The increased diameter of the rim (44) allows for a modified lid (45) with a larger diameter and a greater surface area while enlarging the exposed liquid surface area, both factors contributing substantially to an increased cooling rate. The increased rim (44) diameter of the modified cup (43) also allows the opening (4) to be aligned with the inner wall (49) of the lower part of the cup (43), which decreases the angle that the modified cup (43) needs to be tipped in order to transfer liquid contents to the upper compartment (16). In order to accelerate the cooling of the liquid contents of the upper compartment (16), vent openings (46) are introduced as optional features in the modified lid (45) surface, strategically located beyond the liquid level in both the tipping orientation and sipping orientation to avoid spilling.

FIGS. 23, 24, 25 and 26 show the preferred embodiment of the invention for use with a permanent coffee mug. This embodiment is not disposable, and is constructed of more durable materials. This embodiment encompasses many of the basic features of the preferred disposable embodiment detailed above, including the physical barrier (10), the opening (4), the raised wall (5) defining the opening (4), the perimeter wall (6), and the resulting basin (9) defined by these features. A durable swing gate (22) is used in this embodiment rather than the cheaper flap gate (15) above. This swing gate (22) swings on a mechanical hinge (23) and has an attachment comprised of an extended vertical arm (31) with an eccentric mass (30) attached to its extreme end located on the underside of the swing gate (22). This feature assists the opening of the swing gate (22) during the liquid transfer process when the cup is in its tipping orientation. It also prevents the backflow of liquid when the cup is in its sipping orientation, by introducing a counteracting moment which keeps the swing gate in a closed position.

In order to allow the user the option of accessing the cup's liquid contents directly through the sip opening (11), an optional spring-loaded valve (24) is introduced, which is manually controlled and kept closed in its normal operating condition. The spring-loaded valve (24) can be manually controlled through a knob (29) located on the top of the lid (2), which is connected through a removable hook hinge (36) to a lever arm (28), the other end of which is connected through a permanent hinge (32) to the spring-loaded valve (24). This design feature allows the user to disengage the removable hook hinge (36) and remove the device (3) from the lid (2) when necessary for cleaning purposes.

To set the spring-loaded gate (24) in the open position, the user slides the knob (29) away from the sip opening (11) until the hook attachment (33) of the knob (29) engages the cavity recess (34) provided strategically at the end of the knob's (29) travel path on the surface of the lid (2). The movement of the lever arm (28) is accommodated during this process by a slot opening (59) on the lid (2) surface, orientated and sized according with the knob's (29) travel path. Because the slot opening (59) is open vented and not sealed the design has to consider the safety margins of the level of the liquid contents when the cup-lid assembly is tipped during the liquid transfer and in the sipping orientation.

Figure 26:
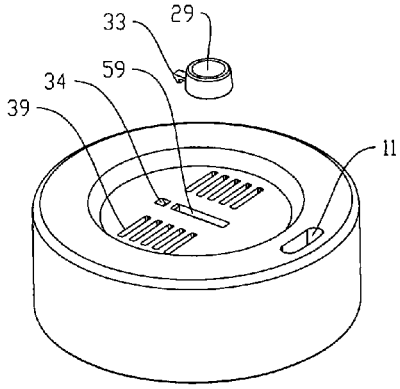
FIG. 26 is an exploded perspective view of the lid of the permanent mug assembly in FIG. 25.
Figure 25:
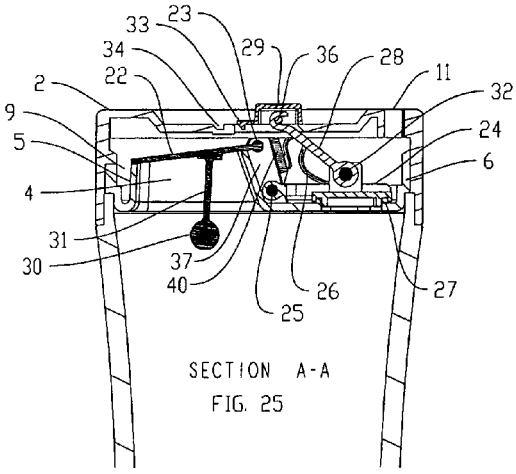
FIG. 25 is a cross section of the device of FIG. 23 in a permanent mug assembly taken along line "A-A" in FIG. 24.
Figure 23:
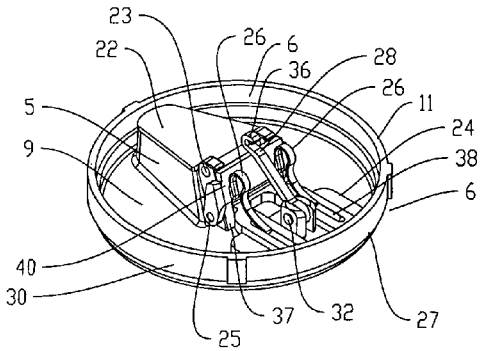
FIG. 23 is a perspective view of the preferred embodiment of the device for a permanent coffee mug.

The spring-loaded valve (24) has a gasket (27) on its underside to seal the physical barrier (10) when it is closed. The spring mechanism, which under normal operation keeps the spring-loaded gate (24) in a leak tight position, is constructed of high strength flexible plastic materials, and consists of two flex arms (26) that are fixed on a platform (40), which are attached to hinge support columns (37) of the swing gate (22). When the user opens the spring-loaded gate (24), the flex arms (26) travel through the groove cavities (38) of the spring-loaded gate (24) while the spring-loaded gate (24) is rotating, creating a counteracting force which tends to swing the spring-loaded gate (24) back to its original (closed) position. In order to accelerate the cooling of the liquid contents of the upper compartment (16), strategically located vent openings (39) are introduced as optional features on the lid (2) surface, as shown in FIGS. 25 and 26.

Figure 27:
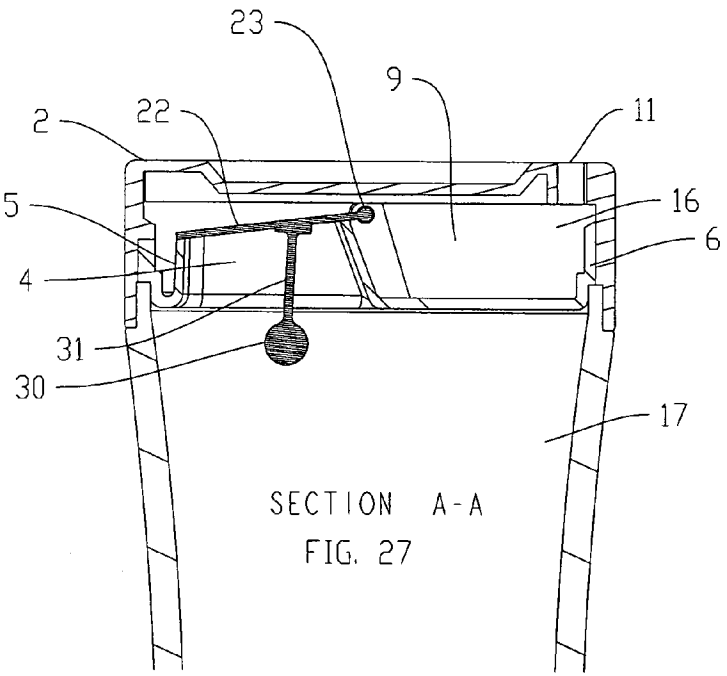
FIG. 27 is a cross section of an alternate permanent mug assembly showing an embodiment of the invention with one raised opening.

FIG. 27 shows an alternative mug design in which only the raised opening (4) in the physical barrier (10) is used. This embodiment is similar in function to the preferred disposable embodiment, in that the opening (4) retains liquids by means of raised walls (5) around the opening (4). Unlike the disposable embodiment, this embodiment has features of the preferred mug design, including the swing-gate (22), the hinge (23), and the extended vertical arm (31) with an eccentric mass (30) attached to its extreme end. Although the absence of the manually controlled spring-loaded gate (24) eliminates the ability of the user to manually open a new path for direct access to the lower compartment (17), direct access to the lower compartment (17) may be achieved if the lid (2) is designed so it may be rotated 180 degrees so that it is above the opening (4).

Figure 28:
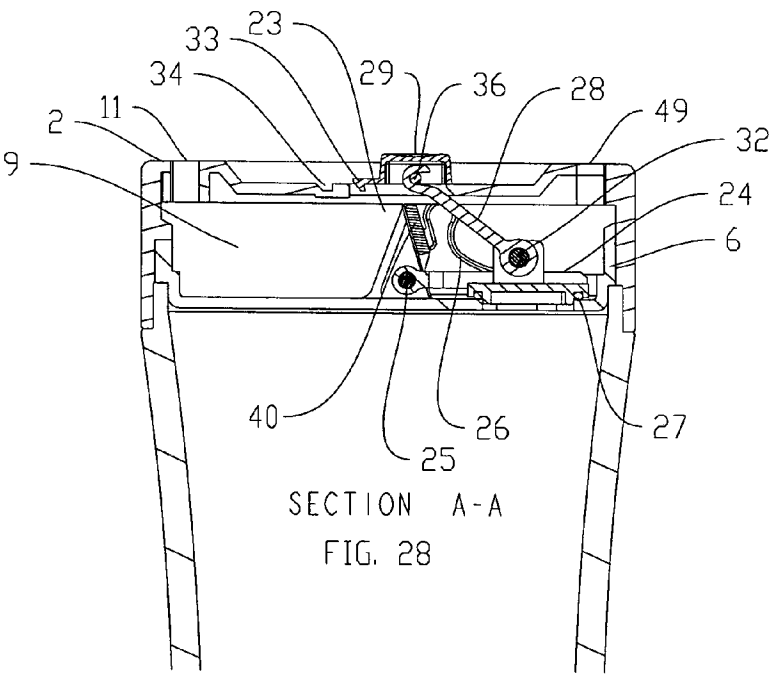
FIG. 28 is a cross section of an alternate permanent mug assembly showing an embodiment of the invention with one manually controlled opening.

FIG. 28 depicts an alternative mug design in which only the spring-loaded gate (24) is used. In this embodiment, the sip opening (11) is positioned opposite the spring-loaded gate (24). Thus, the user may use the knob (29) to open the spring-loaded gate (24) and then tilt the mug to its tipping orientation. The user may then close the spring-loaded gate while in its tipping orientation to trap fluids in the upper compartment (16). These hot fluids cool, and then are accessible via the sip opening (11) when the user wishes to drink. A second sip opening (49), which is ordinarily closed, may be used to offer the drinker direct access to the contents of the lower compartment (17) when the spring-loaded gate (24) is open.

Many other variations are possible in accordance with the present invention. For example, the physical barrier (10) need not be circular, but can take other shapes in dependence upon the shape of the cup or bowl it is intended to partition. The device need not conform to the entire perimeter of the cup or bowl it partitions, and may even allow the lower compartment to have partial access to the lid of the cup or bowl. As another example, the physical barrier may be made in different sizes to fit different sizes of cups. For example, it is customary to provide cups in three different sizes, and the physical barrier in accordance with the present invention could be manufactured to fit each of the cup sizes. Moreover, any of the variations described for a particular embodiment may be employed in any of the other embodiments.

While the present invention has been described with reference to the foregoing embodiments, changes and variations may be made therein which fall within the scope of the appended claims.

What is claimed is:

1. A device for use with a cup and lid, said cup containing liquid contents, said device comprising:

a component creating a physical barrier, said physical barrier dividing the interior space enclosed by said cup and said lid into an upper compartment and a lower compartment, said upper compartment confined between said barrier and said lid above; and said lower compartment below said barrier;

an opening in said physical barrier for the transfer of liquid contents from said lower compartment past said physical barrier into said upper compartment when said cup is in a tipped orientation, said physical barrier and said opening so constructed to prevent the backflow of contents from said upper compartment back into said lower compartment when said cup is in its upright orientation or in its sipping orientation;

wherein said opening is raised with respect to said physical barrier forming a raised region, and wherein said opening has a gate that remains closed when said cup is in its sipping or upright orientation, but opens when said cup is in its tipped orientation;

wherein said gate flexes to accommodate transfer of liquid contents when said cup is in its tipped orientation; and, and wherein said physical barrier also includes a perimeter wall forming a basin in said upper compartment around said raised region.

2. The device in claim 1, where said gate is forced open by flow of the transferred liquid contents when said cup is in its tipped orientation.

3. The device in claim 1, where said gate is hinged and swings open when said cup is in its tipped orientation.

4. The device of claim 1, in which said physical barrier is substantially constructed of a thermal insulating material.

5. The device in claim 1, where said physical barrier substantially improves the rigidity of the cup and lid assembly.

6. A device adapted to be inserted into a disposable cup containing liquid contents before a lid is placed on said cup, the device comprising:

a physical barrier insertable into the cup creating two compartments: an upper compartment between said physical barrier and the lid, and a lower compartment below said physical barrier;

a raised region on the physical barrier sufficiently protruding into the upper compartment to prevent liquid from returning from the upper compartment to the lower compartment when the cup is level or in a sipping configuration, said raised region having an opening that allows fluid communication between the lower and upper compartment when the cup is in a tipped configuration;

a gate covering said opening that allows liquid to flow from the Lower compartment to the upper compartment when the cup is in a tipped Configuration;

and wherein said physical barrier also includes a perimeter wall forming a basin in said upper compartment around said raised region.

7. The device of claim 6 wherein said gate is forced open by flow of transferred liquid contents when the cup is in said tipped orientation.

8. The device of claim 6 wherein said raised region has a substantially vertical wall.

9. The device of claim 6 wherein said raised region contains a vent.

10. The insert of claim 1 adapted so that when a lid with a sip hole is placed on the cup so that the sip hole is aligned 180degrees from said opening in the raised region, liquid may be cooled in the upper space, but when the sip hole is directly aligned with said opening, liquid may be consumed directly from the lower space.

11. The device of claim 1 wherein the physical barrier is supported by said cup's inner wall.

12. The device of claim 1 wherein the physical barrier is supported by said cup's rim.

13. A dish-like insert device for a coffee cup, the device including a perimeter wall matching the geometry of the inside surface of the cup comprising:

said device having an elevated region with a gate, said gate designed to flex when subjected to an internal pressure;

said device, when positioned in a cup with liquid contents, being adapted to rest below the rim of the cup, the device having its perimeter wall bearing on the inside surface of the cup creating a tight fit while providing a supporting base for the device;

whereby, when the cup with a lid, containing liquid contents and equipped with the device, is tilted away from a user, a small portion of liquid is transferred through the gate into the upper space, while when the cup is in an upright or sip position, the liquid in the upper space is prevented from flowing back into the lower space;

said device being adapted so that when a lid with a sip hole is placed on the cup so that the sip hole is aligned 180 degrees from said opening in the elevated region, liquid may be cooled in the upper space, but when the sip hole is directly aligned with said gate, liquid may be consumed directly from the lower space.

* * * * *

UNITED STATES PATENT AND TRADEMARK OFFICE

CERTIFICATE OF CORRECTION

PATENT NO. : 8,469,227 B2
APPLICATION NO. : 11/980186
DATED : June 25, 2013
INVENTOR(S) : Lazaros C. Tripsianes It is certified that error appears in the above-identified patent and that said Letters Patent is hereby corrected as shown below:

On the Title Page, Item (76)

Please correct the inventor's name on the patent. The correct name is Lazaros C. Tripsianes not Laxaros Tripsiznes.

Signed and Sealed this
Fifth Day of May, 2015

Michelle K. Lee

Michelle K. Lee
*Director of the United States Patent and Trademark Office*